US005508933A

United States Patent [19]

Abumehdi

[11] Patent Number: 5,508,933

[45] Date of Patent: Apr. 16, 1996

[54] FRANKING MACHINE AND METHOD

[75] Inventor: Cyrus Abumehdi, Harlow, United Kingdom

[73] Assignee: Neopost Ltd., Essex, United Kingdom

[21] Appl. No.: 389,616

[22] Filed: Feb. 15, 1995

Related U.S. Application Data

[63] Continuation of Ser. No. 169,357, Dec. 20, 1993, abandoned.

[30] Foreign Application Priority Data

Dec. 23, 1992 [GB] United Kingdom ..... 9226813

[51] Int. Cl.[6] ..... G07B 17/00

[52] U.S. Cl. ..... 364/464.02

[58] Field of Search ..... 364/464.02

[56] References Cited

U.S. PATENT DOCUMENTS 4,649,266 3/1987 Eckert ..... 364/464.02 X
4,812,994 3/1989 Taylor et al. ..... 364/464.02
4,813,912 3/1989 Chickneas et al. ..... 364/464.02
4,831,554 5/1989 Storace et al. ..... 364/464.02
4,858,138 8/1989 Talmadge ..... 364/464.02

FOREIGN PATENT DOCUMENTS 2174039 10/1986 United Kingdom .
2190044 11/1987 United Kingdom .

*Primary Examiner*—Edward R. Cosimano
*Attorney, Agent, or Firm*—Shoemaker and Mattare, Ltd.

[57] ABSTRACT

Security is provided to a franking impression printed on mail items by including a multi-character code in the franking impression. The multi-character code includes a two digit code derived from a security key and a postage charge for an item, a two digit code derived from the postage charge for the item and the date of franking and a four digit item count.

10 Claims, 2 Drawing Sheets

FRANKING MACHINE AND METHOD

This application is a continuation of application Ser. No. 08/169,357, filed Dec. 20, 1993 now abandoned.

BACKGROUND OF THE INVENTION

This invention relates to franking of mail items and in particular to providing security for franking impressions printed on mail items.

Known franking machines utilise a print drum carrying settable print wheels to print franking impressions on mail items. The print drum carries a print die to print fixed information in the franking impression which usually comprises a fixed pattern as determined by the postal authority together with a franking meter licence number and the postal area from which the franked mail is dispatched. A further die may be provided to enable the printing of a slogan, for example advertising material relating to the sender of the mail item. The print wheels carried by the print drum are utilised to print a value of postage charge and the date on which the mail item is franked. The print wheels have type characters on their peripheries and are rotated relative to the print drum to bring a selected type character into printing position. Rotation of the print wheels used to print the postage value is effected by means of mechanisms controlled by electronic control and accounting circuits so as to set the print wheels to print a desired postage charge which has been entered by the user into the franking meter, for example by operation of thumb wheels or keys of a keyboard. It will be appreciated that, in order to prevent fraudulent printing of franking impressions, it is essential to ensure that the print wheels are able to print only the value of postage charge which has been entered properly into the franking meter and for which proper accounting has been effected by the accounting circuit of the meter. Furthermore it is necessary to permit only a single rotation of the print drum for each postage value accounted for by the accounting circuit and to prevent rotation of the print drum which could be used to print multiple franking impressions on mail items for which no accounting has been effected. With a mechanical printing arrangement such as a print drum and print wheels security of printing of franking impressions can be effected relatively easily by means of appropriate construction of mechanisms for setting the print wheels and retaining them in their set positions during rotation of the print drum and for preventing rotation of the print drum except when permitted by the accounting and control circuits. These mechanisms are housed together with the accounting and control circuits in a secure housing which prevents unauthorised tampering with the printing devices.

However such mechanisms for printing franking impressions with selected postage values are relatively complex and expensive to manufacture. Accordingly it has been proposed to use digital techniques for printing the franking impression. In such digital techniques a plurality of printing elements, such as ink jet or thermal ink transfer, are disposed in a matrix or a line and are operated selectively so as in combination to print a complete franking impression. When the printing elements are disposed in a line, the elements are operated selectively and repeatedly while the mail item is fed past the line of elements to progressively build up a complete franking impression. Digital printing devices are operated by electrical signals generated by the accounting and control circuits and this poses problems in ensuring adequate security in printing franking impressions because it is difficult to prevent false electrical signals being applied to operate the printing elements to print a franking impression with a value of postage charge for which proper accounting has not been effected.

SUMMARIES OF THE INVENTION

According to one aspect of the invention a franking machine includes printing means operable to print franking impressions on mail items; electronic accounting and control means operable to carry out accounting functions in respect of values of postage charge selected for franking respective mail items and operative to utilise said selected value to maintain account records in respect of use of funds in franking a plurality of mail items and operative to control said printing means to print a franking impression on a mail item, said franking impression including items of information including the selected value of postage charge; said accounting and control means including means operative to generate a multi-character code which is changed for each of a series of mail items and includes at least one code character which has a predetermined relationship to at least one of said items of information included in the franking impression and said accounting and control means being operative to control the printing means to print the multi-character code on the mail items.

According to another aspect of the invention a franking machine includes means to store a real time dependent signal and a security key and means responsive to said time dependent signal and to the stored security key to permit operation of the franking machine during a predetermined time period if the stored security key has a first value and to inhibit operation of the franking machine in respect of franking mail items if the stored key has said first value after elapse of said time period.

According to a third aspect of the invention a method of franking mail items comprises the steps of printing a franking impression including a first item of postage information comprising a value of postage charge and a second item of postage information; generating a multi-character code, said code being different for each of a series of mail items and including at least one code character having a predetermined relationship to at least one of said first item of postage information and said second item of postage information and the step of printing said multi-character code as a part of said franking impression.

BRIEF DESCRIPTION OF THE DRAWING

An embodiment of the invention will now be described by way of example with reference to the drawings in which.

DESCRIPTION OF THE PREFERRED EMBODIMENT

Figure 1:
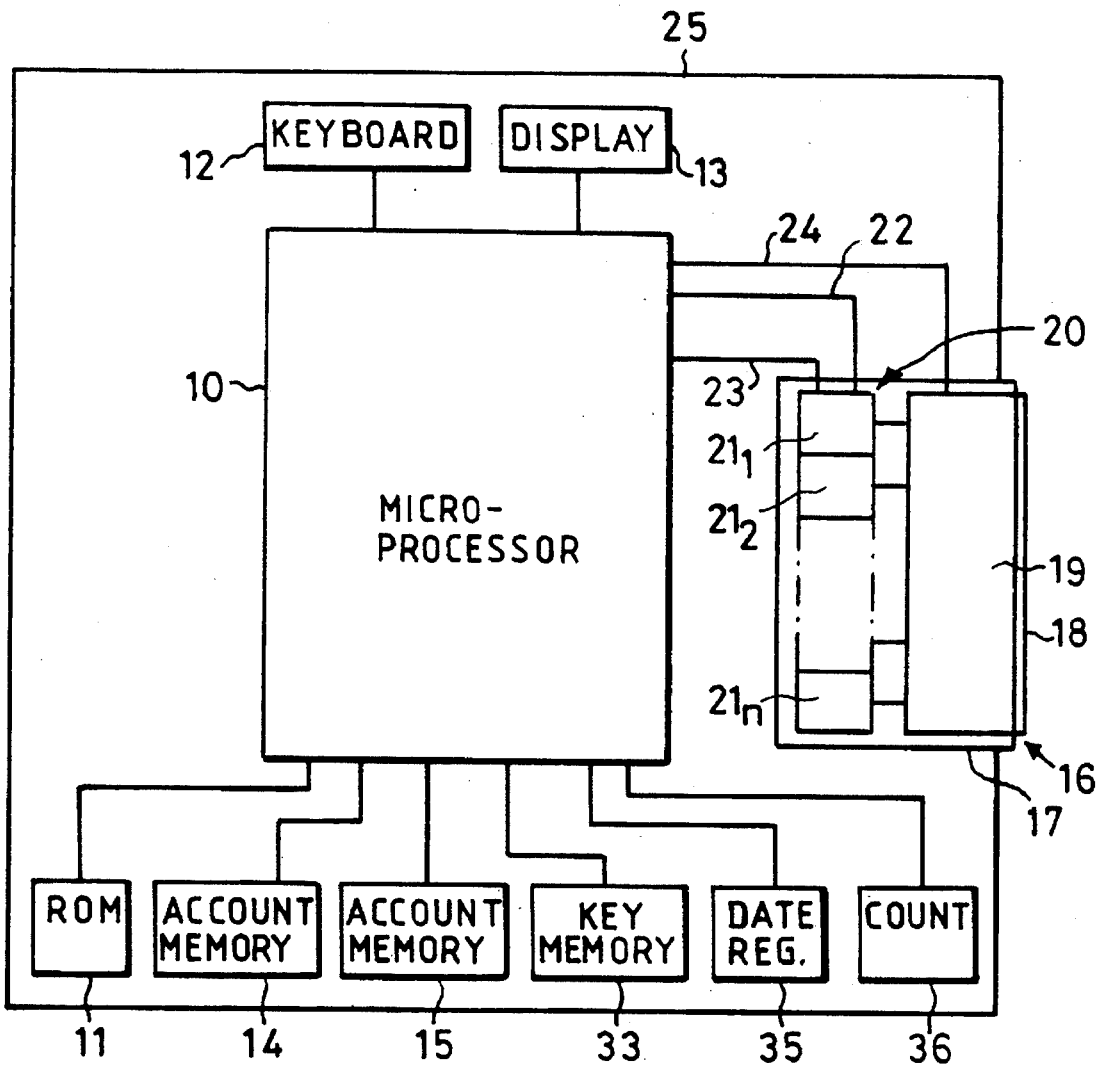
FIG. 1 is a block diagram of a franking machine.

Referring first to FIG. 1, a franking machine includes a micro-processor 10 for carrying out accounting and control operations under the control of program routines stored in a read only memory (ROM) 11. A keyboard 12 is provided to permit a user of the machine to input command signals to the micro-processor 10 to cause the micro-processor to carry out desired operations, for example a franking operation to print a franking impression on a mail item or a re-crediting operation to update credit stored in a descending register of the franking machine. The keyboard also permits the entry of postage values to cause the micro-processor 10 to account for and control printing of a desired value of postage charge in the franking impression. A display device 13 is operated by the micro-processor to provide information to the user of the machine, such displayed information may include an echo of inputs on the keyboard to enable verification of the keyboard entry and information relating to the operational status of the machine.

Accounting information is stored in registers in non-volatile memory devices 14, 15. Usually the registers include a descending register to store a value of credit available for use in franking operations, an ascending register to store a value of accumulated postage value used in franking operations, an items register to store a count of the number of mail items franked and a high items register to store a count of the number of items franked with a value of postage charge in excess of a predetermined value. To ensure integrity of the stored accounting data and to enable recovery of data in the event of a fault arising, each register is provided in duplicate in each of the non-volatile memory devices 14, 15.

Franking impressions are printed on mail items by means of thermal print head 16 which comprises a substrate 17 carrying a resistive conductor 18 extending along or adjacent an edge of the substrate. The resistive conductor is divided electrically into a plurality of thermal printing elements by means of a plurality of electrical connections (not shown) spaced along the length of the resistive conductor 18 and connected to electronic switches 19. The substrate also carries a register 20 comprising a plurality of storage locations $\mathbf{21}_1$–$\mathbf{21}_n$ corresponding respectively to the plurality of thermal printing elements. The storage locations 21 of the register 20 are connected to corresponding thermal printing elements by way of the switches 19. When printing of a franking impression is to be effected, the micro-processor outputs a series of strings of print data signals on line 22 and the print data signals of a string are entered into the storage locations of the register under the control of clock signals on line 23. Strobe signals are input to the switches 19 on line 24 to energise selected ones of the print elements to cause heating of those selected elements which is effective to transfer ink from a thermal transfer ink ribbon (not shown), interposed between the print elements and the mail item, from the ribbon to the mail item and thereby print dots in selected positions in a line on the mail item. The strobe signals are maintained in synchronism with feeding of the mail item pass the row of thermal print elements and successive strings of print data signals control the operation of the thermal print elements for each successive strobe signal and hence a printed franking impression is built up line by line as the mail item is fed past the row of thermal print elements and the elements are operated selectively and repeatedly.

Figure 3:
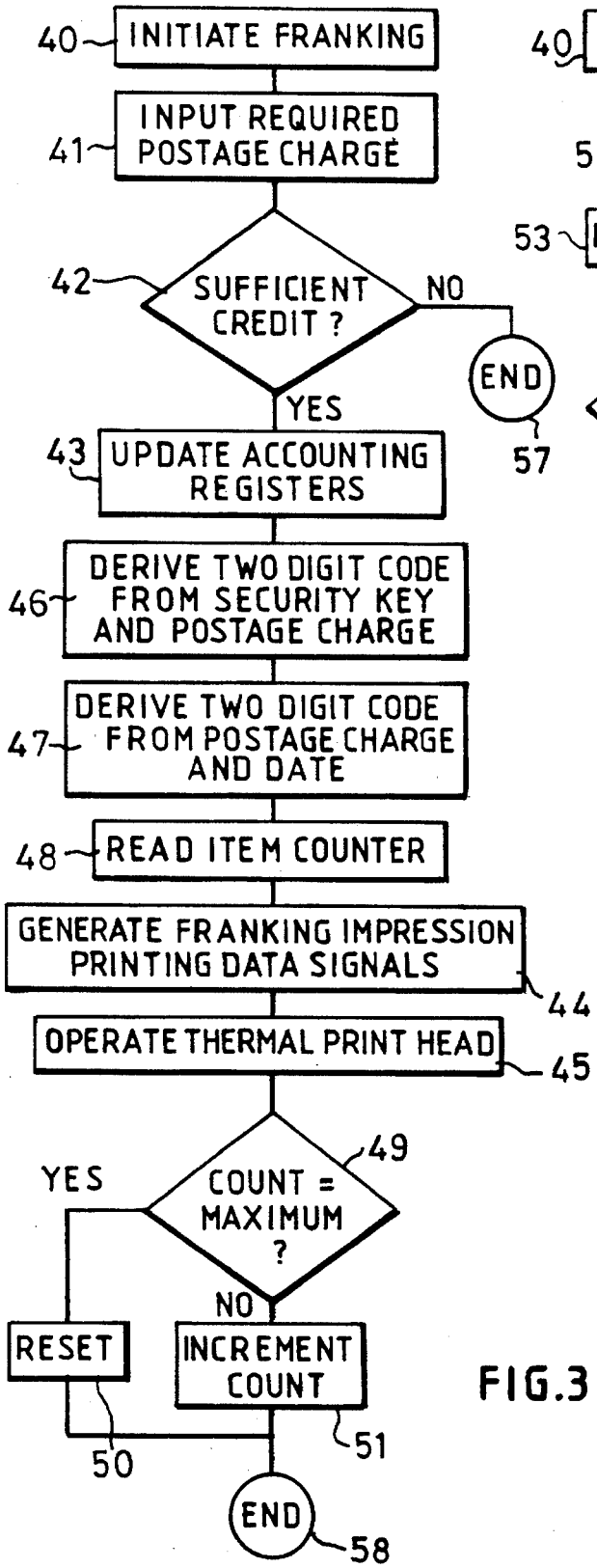
FIG. 3 is flow chart illustrating steps carried out in a routine for franking mail items.

When it is desired to frank a mail item, the user operates the keyboard to initiate (step 40, FIG. 3) the franking machine to carry out a franking operation and enters (step 41) a value of postage charge. The micro-processor operates under a program routine to check (step 42) that sufficient credit is available in the descending register for the required franking and, if sufficient credit is available, updates (step 43) the values stored in the descending and other registers in the memory devices 14, 15 to reflect the current franking operation and generates (step 44) print data signals, clock signals and strobe signals to operate (step 45) the printing device 16 to print the franking impression containing the selected value of postage charge on a mail item. If sufficient credit is not available, as determined by the check ("NO" exit of box 42), the program routine terminates (END 57).

It will be appreciated that if unauthorised tampering with the electronic circuits of the franking machine occurred, there is the possibility that the franking machine could be caused to print franking impressions on mail items for which proper accounting had not be effected. For example, the machine might be caused to print franking impressions without any accounting being effected so that the credit value stored in the descending register is not decremented or be caused to print franking impressions containing a higher value postage charge than that for which the accounting is effected. Accordingly as is well known in the franking machine art, the electronic circuits of the franking machine are housed in a secure housing, indicated by line 25 to prevent unauthorised tampering with the circuits. However in order to enable the resistive thermal printing elements to be in good thermal engagement with the ink transfer ribbon the resistive conductor forming the print elements is disposed externally of the secure housing. As a result the resistive conductor 18 is vulnerable to tampering and there is a possibility of an unauthorised person making connections either directly to the resistive conductor or to the circuits immediately adjacent the conductor and thereby causing the print head to operate in an unauthorised manner to print fraudulent franking impressions.

Figure 2:
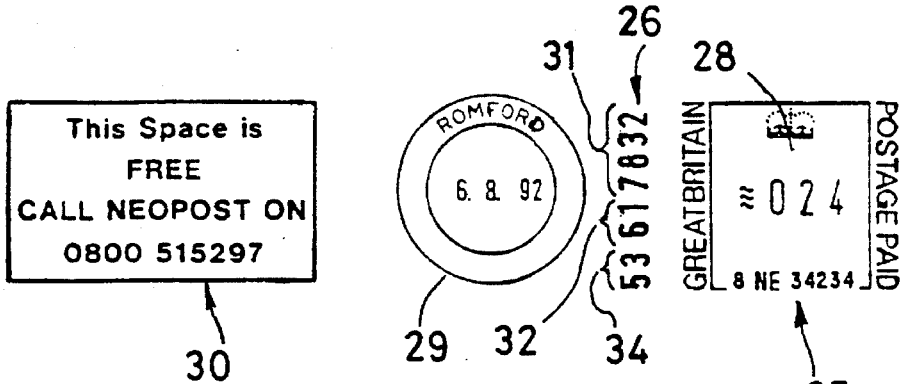
FIG. 2 illustrates a form of franking impression printed by the franking machine of FIG. 1.

In accordance with the invention and as shown in FIG. 2, the printed franking impression contains security data 26 which varies in a manner which is not easily apparent from observation of previously printed franking impressions but can be examined by postal authority personal to verify validity of franking impressions printed on mail items.

The franking impression, as shown in FIG. 2 has a form as determined by the postal authority and in the United Kingdom the impression has the form of a portion 27 of generally rectangular form containing the value of postage charge 28 for which the mail item is franked and the serial or licence number of the postage meter and a generally circular portion 29 containing the postal location of the postage meter and the date on which the franking impression is printed. It will be appreciated that the franking impression may have other forms as determined by the postal authority or other carrier of the specific country or territory in which the franking machine is utilised for franking mail items. In addition it is common for an advertising slogan 30 to be printed alongside the franking impression at the time of printing the franking impression.

The security data includes a four digit serial number 31, a two digit code 32 derived from a security key stored in a non-volatile security key register 33 (FIG. 1) and the value of postage charge selected to be printed in the franking impression and for which proper accounting has been effected and a further two digit code 34 derived from the date on which the franking impression is printed and the value of postage charge selected to be printed in the franking impression and for which proper accounting has been effected. The date is stored in a date register 35 (FIG. 1) and this may be derived from an internally operated time clock of the postage meter or the date may be entered each day on the keyboard for entry and storage in the date register 35. The four digit serial number is derived from a four digit counter 36 which is incremented by one for each franking operation. When the counter reaches its maximum count it is reset and continues to be incremented. It is to be understood that the numbers of digits of each code referred to hereinbefore are by way of example only. However it is preferred that the code 31 comprises up to four digits and that the codes 32 and 34 comprise at least two digits.

When a franking operation is initiated (step 40) by a user and the desired value of postage charge is input (step 41) on the keyboard, the micro-processor utilises an algorithm to derive (step 46) the two digit code 32 from the security key stored in the security key register 33 and the value of postage charge input on the keyboard by the user. The microprocessor also uses an algorithm to derive (step 47) the two digit code 34 from the date information stored in the date register 35 and the value of postage charge input on the keyboard by the user. The count in the counter 36 is read (step 48). The microprocessor generates (step 44) the print data signals such as to define a franking impression including not only any required invariable pattern, the postage charge and date but also the code comprising the four digit code 31, the two digit code 32 and the two digit code 34 described hereinbefore. After reading the count of the counter 36 (step 48), a determination (step 49) is made to determine if the count value is a maximum count for the counter. If the count value is a maximum, the counter is reset (step 50) otherwise the count is incremented (step 51). After the counter is reset (step 50) or the count is incremented (step 51), the program routine terminates (END 58).

Thus the security data is different for each successive franking operation on the same date even if the value of postage charge remains the same for a number of mail items because the four digit serial number is incremented. Furthermore both of the two digit codes 32 and 34 vary in dependence upon the value of postage charge selected and in addition the two digit code 34 is different for each day. The two digit code 34 is dependent only on the date and the value of postage charge. Accordingly all mail items franked on any one date with the same value of postage charge will bear the same two digit code 34 and this facilitates a visual check of franked items to verify that items franked on the same date for the same amount bear the correct code 34. The code 32 is derived from a secure key in the key memory 33 which is unique to the postage meter. A further check on the veracity of the value of postage charge printed may be effected by the postal authority by deriving a two digit code from the unique key provided by the authority for that meter and the value of postage charge printed in the impression. If the two digit code thereby derived is equal to the two digit code 32 printed in the franking impression it indicates that the value of postage charge printed is genuine.

If desired the security key may be changed from time. The change of security key may be effected at random times or may be at predetermined times. The security key may be changed by the user of the franking machine requesting the postal authority to issue a new security key and, upon receiving the new key, entering it by means of the keyboard into the key memory 33 to replace the previous security key. Instead of entry of the new security key by the user by means of the keyboard, the new security key may be entered by means of a communication link between the postal authority and the franking machine. The communication link may be provided by a direct telephone connection or by means of a transportable memory device which can be connected to the franking machine.

Figure 4:
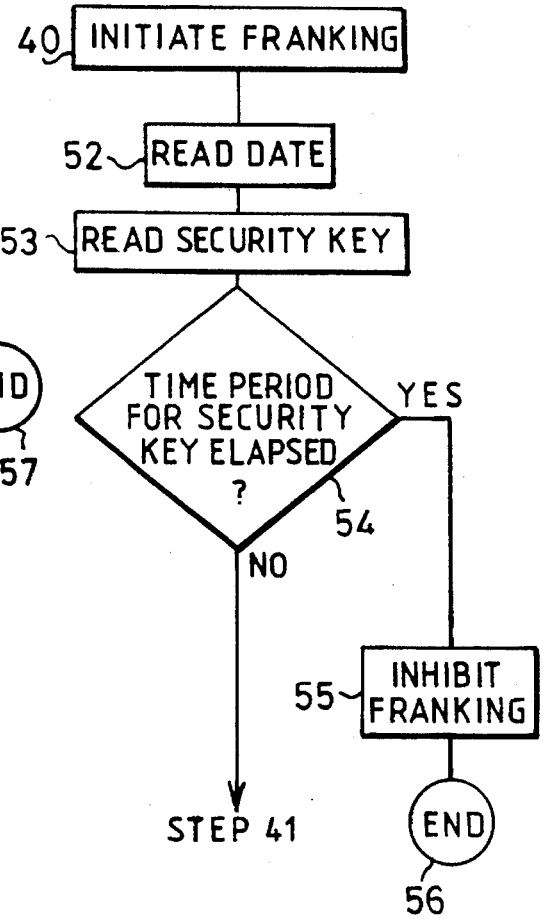
FIG. 4 is a flow chart relating to determination of validity of a security key required for operation of the franking machine.

The franking machine may be arranged to operate in respect of a specific security key only during a predetermined time period and upon elapse of that time period to be inhibited from carrying out operations to frank mail items. Accordingly, as illustrated in the flow chart of FIG. 4, the microprocessor, after initiation of a franking operation, reads (step 52) the date stored in date register 35 and reads (step 53) the value of security key stored in key memory 33 and is responsive to the date and to the value of the security key to determine (step 54) if the time period has lapsed for which that specific key is valid. When the security key has a first value and a first time period is current and has not elapsed, the microprocessor is operable to carry out franking of mail items proceeds to step 41 of the flow chart of FIG. 3. However upon elapse of the time period, if the security key has the first value, operation of the franking machine for franking mail items is inhibited (step 55) and the franking operation is terminated (step 56). Upon entry of a new security key, the microprocessor carries out the steps 52, 53, 54 and if the new security key is determined to be valid the microprocessor is enabled to carry out franking operations for the duration of a new predetermined time period. Inhibition of the franking machine from carrying out franking operations may comprise merely the inhibition of the microprocessor from initiating a franking routine or may include operation of the microprocessor to effect printing of a message that franking is inhibited and a new security key is required or to effect printing of a garbled impression which clearly is not a valid franking impression.

The entry of a new security key in order to permit continued use of the franking machine may be associated with the provision of status data relating to use of the franking machine up to that time by the user to the postal authority. Thus when a new security key is required by the franking machine a procedure may be invoked in which status data including the values stored in the accounting registers is transmitted either by the user or directly by the franking machine over a communication link to the postal authority. The postal authority is thereby enabled to check the received status data and to issue a new security key only if the status data is satisfactory. Since new security keys are required periodically, the postal authority will receive status data relating to use of the franking machine for each period of use.

While the key memory 33, date register 35 and serial number counter 36 may be implemented as separate semiconductor devices they may be implemented by registers in one or both of the account memory devices 14, 15.

I claim:

1. A franking machine including printing means operable to print franking impressions on mail items; electronic accounting and control means operable to carry out accounting functions in respect of values of postage charge selected for franking respective mail items and operative to utilise said selected value to maintain account records in respect of use of funds in franking a plurality of mail items and operative to control said printing means to print a franking impression on a mail item, said franking impression including items of information including the selected value of postage charge; said accounting and control means including means operative to generate a multi-character code; said multi-character code including a first code part having a first predetermined relationship to at least one of said items of information included in the franking impression and said multi-character code including a second code part distinguishable from said first code part and having a second predetermined relationship to at least one of said items of information included in the franking impression and said accounting and control means being operative to control the printing means to print the multi-character code on the mail items.

2. A franking machine as claimed in claim 1 wherein the accounting and control means is operative to control the printing means to print the current date in the franking impression and wherein the first code part has the first predetermined relationship to the current date on which the franking impression is printed and the selected value of postage charge.

3. A franking machine as claimed in claim 1 wherein the accounting and control means includes a counter which is incremented for each mail item franked and in which the multi-character code includes a third code part comprising at least one character of said multi-character code corresponding to a count of said counter.

4. A franking machine as claimed in claim 2 wherein the accounting and control means is operative to control the printing means to print the current date in the franking impression and wherein the first code part has the first relationship to the current date on which the franking impression is printed and the selected value of postage charge.

5. A franking machine as claimed in claim 1 wherein the accounting and control means includes storage means to store a security key and is operative to generate at least one the first code part and the second code part of the multi-character code determined by the security key and the selected value of postage charge.

6. A franking machine as claimed in claim 5 including means to store a real time dependent signal and means responsive to said real time dependent signal and to the stored security key to permit operation of the franking machine during a predetermined time period if the stored security key has a first value; to inhibit operation of the franking machine in respect of franking mail items if the stored security key has said first value after elapse of said time period and to permit operation of the franking machine after elapse of said time period if the stored security key has a second value different from said first value.

7. A franking machine as claimed in claim 6 wherein means are provided to permit entry of the second value of security key into said storage means to permit operation of the franking machine in respect of franking mail items after elapse of the time period.

8. A franking machine including means to store a real time dependent signal and a security key and means responsive to said time dependent signal and to the stored security key to permit operation of the franking machine during a predetermined time period if the stored security key has a first value, to inhibit operation of the franking machine in respect of franking mail items if the stored key has said first value after elapse of said time period and to permit operation of the franking machine after elapse of said time period if the stored security key has a second value different from said first value.

9. A method of franking mail items including the steps of inputting a postage charge with which an item is to be franked; storing a key and utilising said key to derive a first code element from said postage charge; storing date data representing a date on which franking is effected; deriving a second code element from said postage charge and said date data; storing a count of number of mail items franked; generating a multi-character code including said first code element, said second code element and said count and printing a franking impression on a mail item; said franking impression comprising said postage charge, said date and said code, said first code element and said second code element being distinctly recognisable in said multi-character code printed on said mail items.

10. A method of franking mail items comprising the steps of printing a franking impression including a first item of postage information comprising a value of postage charge and a second item of postage information; generating a multi-character code,s aid multi-character code including a first code character which is different for each of a series of mail items irrespective of said first item of postage information and said second item of postage information and said multi-character code including a second code character having a first predetermined relationship to at least a predetermined one of said first item of postage information and said second item of postage information and said multi-character code including a third code character having a second predetermined relationship to said predetermined one of said first item of postage information and said second item of postage information and the step of printing said multi-character code as a part of said franking impression.

* * * * *